United States Patent [19]

Hannett et al.

[11] Patent Number: 4,505,650

[45] Date of Patent: Mar. 19, 1985

[54] DUPLEX COMPRESSOR OIL SUMP

[75] Inventors: William J. Hannett, Jamesville; David S. Wilson, Fayetteville, both of N.Y.

[73] Assignee: Carrier Corporation, Syracuse, N.Y.

[21] Appl. No.: 520,658

[22] Filed: Aug. 5, 1983

[51] Int. Cl.[3] ..... F04B 39/02; F04B 23/06

[52] U.S. Cl. ..... 417/426; 62/468; 440/88

[58] Field of Search ..... 417/426, 281; 62/468; 440/88

[56] References Cited

U.S. PATENT DOCUMENTS

| | | | |
|---|---|---|---|
| 1,446,775 | 2/1923 | Wahl | 440/88 |
| 1,606,060 | 11/1926 | Cox | 417/281 |
| 2,159,815 | 5/1939 | McCone | 417/281 |
| 2,246,244 | 6/1941 | Cowsley | 417/426 |
| 3,621,670 | 11/1971 | Kinney | 62/488 |
| 3,785,169 | 1/1974 | Gylland | 62/488 |

*Primary Examiner*—William L. Freeh

*Attorney, Agent, or Firm*—David J. Zobkiw

[57] ABSTRACT

A duplex compressor arrangement for shipboard application is provided with a central oil pickup to minimize the effects of trim on the sump. Additionally, the compressor crankcases are connected to the sump via return lines and equalizer lines which can act as secondary drain lines under the proper trim conditions.

4 Claims, 3 Drawing Figures

DUPLEX COMPRESSOR OIL SUMP

BACKGROUND OF THE INVENTION

In loading or unloading a ship, it often becomes necessary to load or partially unload the cargo such that the ship is trimmed bow up or down as much as 5 degrees. This is the calm water condition of the ship and at 5 degrees of trim results in a bow to stern difference in elevation of over 8 feet per 100 feet of ship length. Land-based installations routinely use a duplex compressor arrangement where one double shaft motor drives two compressors. However, the roll of a ship requires that such an arrangement be oriented in the direction of the keel of the ship and this creates oil level problems due to the trim of the ship if a conventional system of cross-connecting duplex compressors is used which employs interconnecting tubes above and below the oil level in the crankcases. More specifically, typical large 8-cylinder compressors duplexed and driven by a motor located between them would have the oil pump suction tubes placed about 9 feet apart. Depending upon the trim of the ship, the "low" compressor could have too high of an oil level while the "high" compressor could have too low of an oil level if a conventional system of cross-connecting duplex compressors is used. The "high" compressor would run out of oil, causing the low oil pressure safety switch to stop the motor. Since continuous air conditioning plant operational capability is essential, this situation would be intolerable. The problem cannot be cured by raising the oil level in the compressors since the "low" compressor would have an intolerably excessive oil level long before an adequate level could be established in the "high" compressor.

SUMMARY OF THE INVENTION

The present invention provides a duplex compressor arrangement in which each compressor is provided with an oil pump having its suction line connected to a central sump. Additionally, equalizer lines are provided to equalize the pressures between the two compressor crankcases and the sump. When a bypass oil filter loop is used, the filtered bypass oil may be fed back to the oil suction line rather than to the sump to enhance oil availability to the oil pumps. Return lines are also provided to conduct oil back to the sump after it has performed its lubrication function in the compressors.

It is an object of this invention to provide an equitable oil supply to the compressors of a duplex arrangement for shipboard applications.

It is another object of this invention to provide a duplex compressor oil sump arrangement which provides a proper oil supply over the trim range of a ship.

It is a further object of this invention to provide plural flows of lubricating oil from a sump subject to being placed over a range of orientations. These objects, and others as will become apparent hereinafter, are accomplished by the present invention.

Basically, the duplexed compressors of the present invention are provided with an oil sump arrangement whereby the compressor oil pumps are supplied with sufficient oil over a range of trim conditions for shipboard applications. The oil supply is removed from the influence of the sump orientation due to trim by providing centrally located oil suction line intakes in the sump and by providing an equalizer line between the compressor crankcases and the sump. The sump is generally coextensive with, axially parallel to and at a slightly lower elevation than the duplexed compressors in the preferred embodiment, but need only be lower and centrally located for satisfactory results if the sump configuration maintains a generally stable oil level in the area of the oil intakes. The oil suction lines have a common pickup at the middle of the sump to reduce the influence of trim upon the oil level required in the sump.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
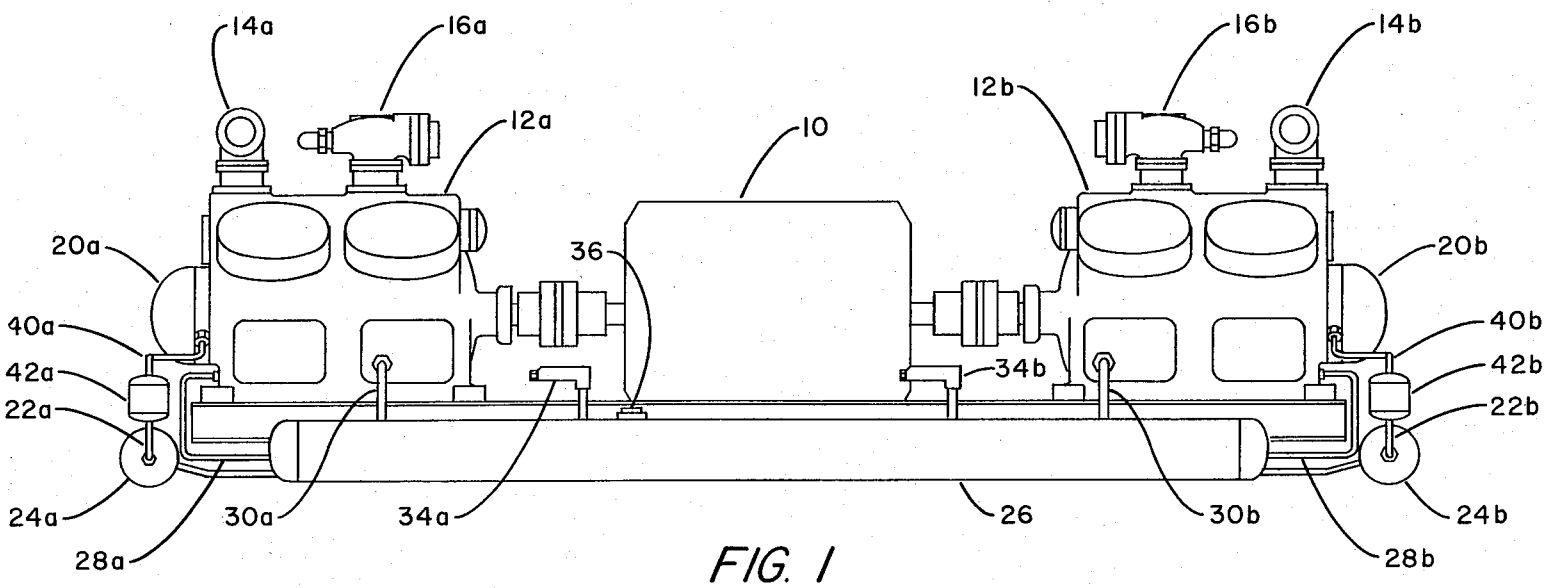
FIG. 1 is a side view of a duplex compressor system employing the present invention.
Figure 2:
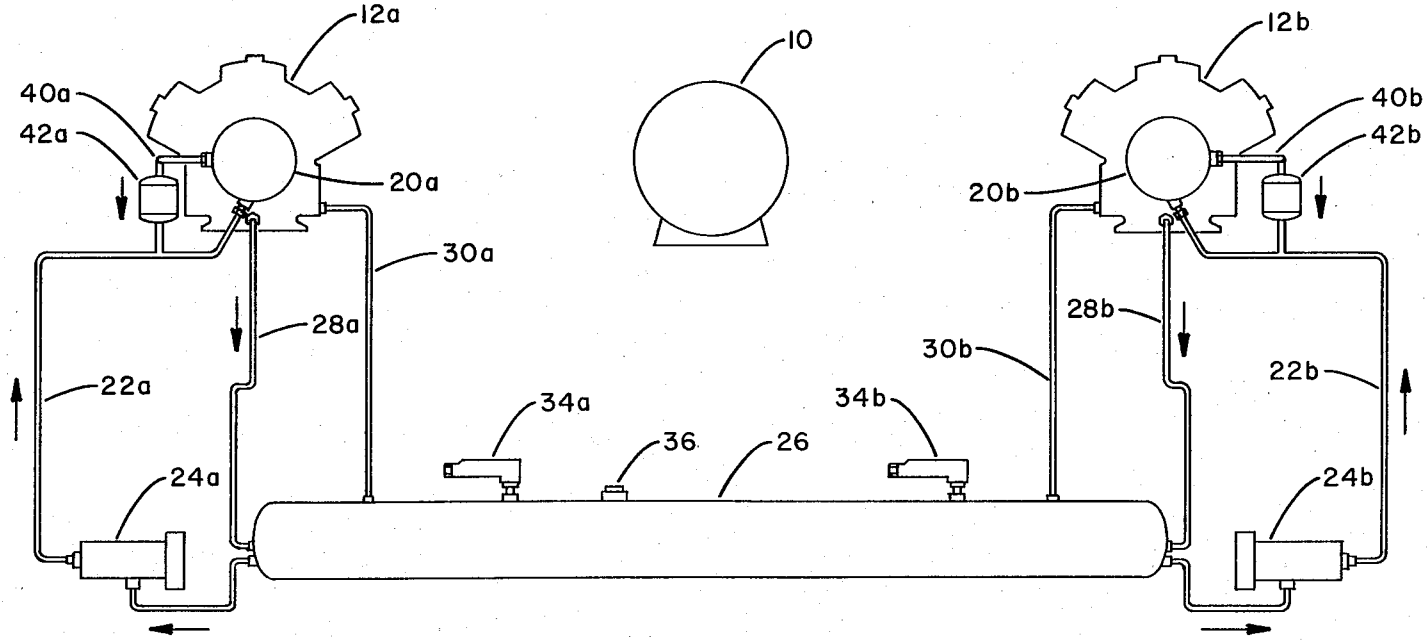
FIG. 2 is a schematic piping diagram of the FIG. 1 system.

In FIGS. 1 and 2 the numeral 10 generally designates a double shaft motor drivingly connected to compressors 12*a* and *b* to form a duplex compressor. Compressors 12*a* and *b* are connected to and form part of a compressor condensing unit of a refrigeration system (not illustrated) and receive low pressure refrigerant vapor via suction lines 14*a* and *b*, respectively, and deliver high pressure refrigerant vapor via discharge lines 16*a* and *b*, respectively, as is conventional. Compressors 12*a* and *b* are supplied with lubricating oil by oil pumps 20*a* and *b*, respectively, which are connected to oil sump 26 via oil suction lines 22*a* and *b* containing strainers 24*a* and *b*, respectively. Excess oil is drained from compressors 12*a* and *b* back to the sump 26 via drain or return lines 28*a* and *b*, respectively. Equalizer lines 30*a* and *b* connect the crankcases of the compressors 12*a* and *b* with the sump 26 to equalize the crankcase pressures and also serve as secondary drains. Electric heaters 34*a* and *b* heat the oil in sump 26 to minimize absorbed refrigerant in the oil and thereby eliminate the problem of foaming of refrigerant at startup and maintain the lubricant viscosity. The oil level is monitored via indicator 36 which is located in the central portion of sump 26 to reduce the effects of trim produced oil level changes and may suitably be a sight glass, a magnetic float, etc. Oil pumps 20*a* and *b* may each have a bypass line 40*a* and *b*, respectively, with optional bypass oil filters 42*a* and *b*, respectively, located therein.

The sump 26 is located at a slightly lower elevation than the motor 10 and compressors 12*a* and *b* and, in the illustrated embodiment, is essentially coextensive with the duplex compressor. However, if necessary or desirable due to the specific criteria of an installation, the sump may be compactly and/or vertically configured if the sump is at a lower elevation and the oil pickup is not influenced by oil level changes due to trim. As a result, the required suction head for the oil pumps 20*a* and *b* is higher than conventional but still within the operating range of conventional oil pumps to optimize the oil supply to the oil pump when a bypass oil filter loop is employed, bypass lines 40*a* and *b* are provided to route the bypass oil directly back to suction lines 22*a* and *b*. The bypass lines 40*a* and *b* thus assist in start up by providing a closer source of oil and provide additional filtered oil to the oil pump 20*a* and *b*. Alternatively, the bypass oil may be returned directly to either the sump or the compressor crankcase by any convenient routing.

Figure 3:
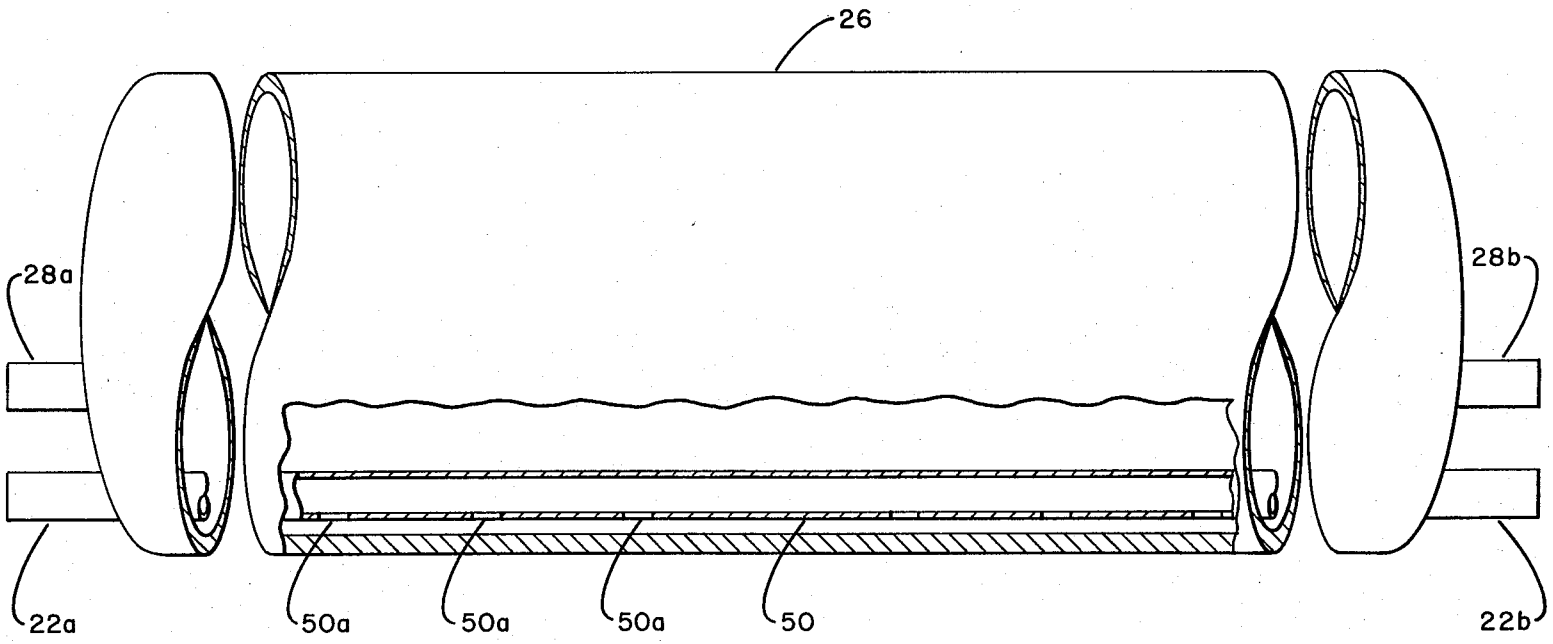
FIG. 3 is a partially cutaway view of the sump.

Referring now to FIG. 3, it will be noted that oil suction lines 22*a* and *b* are connected by tube assembly 50 which has centrally located pickup opening(s) 50*a*. Alternatively, lines 22*a* and *b* may be connected externally of the sump 26 with a single line connected to the sump 26 such as at the bottom of the sump 26 at the middle and the tube assembly may be vertically oriented, a tee, etc.

The crankcase of the compressors 12*a* and *b* are connected to sump 26 by return lines 28*a* and *b* and equalizer lines 30*a* and *b*. Return lines 28*a* and *b* normally permit lubricating oil supplied by oil pumps 20*a* and *b* to drain from the crankcases to the sump 26 while equalizer lines 30*a* and *b* equalize pressures in the crankcases and sump 26. Thus, at even keel, little or no oil will be in the crankcases. Because of effects of trim on the fluid levels in the crankcases, the equalizer lines 30*a* and *b* can also act as secondary crankcase drains. For example, if the duplexed compressors of FIG. 1 are rotated clockwise 5° to represent a trim condition equalizer line 30*a* will exit from compressor 12*a* at a point which will be lower than that of line 28*a* and less oil will be able to build up in the right hand end of the compressor 12*a*.

In summary, the equalizer lines 30*a* and *b* serve to equalize the pressure in the crankcases of compressors 12*a* and *b* with that of sump 26 but also provide an alternate or secondary drain for the compressors 12*a* and *b* when they are tipped. In this manner excess oil is drained back to the sump and is kept from building up in the crankcases and hitting the cranks over the full range of design trim conditions. The suction lines 22*a* and *b* are fed from the sump 26 via openings 50*a* in tube assembly 50 which are centrally located in the sump 26 so as to be minimally influenced by changes in the fluid level in the sump due to the trim of the ship.

Although a preferred embodiment of the present invention has been illustrated and described, other changes will occur to those skilled in the art. For example, the sump configuration and the suction line intakes may be changed in view of space limitations due to design criteria. Also, in certain circumstances a check valve may be desirable in the oil suction line to assist in pump startup. It is therefore, intended that the scope of the present invention is to be limited only by the scope of the appended claims.

We claim:

1. A duplex compressor arrangement in which a pair of compressors are axially aligned with and driven by a motor with the axial alignment having a variable steady state orientation of ±5° from horizontal comprising:

oil sump means at a lower elevation than said compressors and including a tube assembly extending into said sump means and having at least one inlet opening therein;

a pair of oil pump means for feeding oil to each of said compressors and having suction lines fluidly connected to said tube assembly and fluidly communicating with the oil in said oil sump means via said at least one inlet opening;

a pair of return lines connected to each of said compressors and said oil sump means for draining excess oil from said compressors;

a pair of equalizing lines connected to each of said compressors and said oil sump means for equalizing pressure in each of said compressors and said oil sump means and for serving as a secondary drain for draining excess oil which tends to accumulate in said compressors when oriented in an other than horizontal position.

2. The duplex compressor arrangement of claim 1 wherein said sump means is generally coextensive with and axially parallel to said compressors and said tube assembly extends through said sump means with said at least one inlet opening in the central portion thereof.

3. The duplex compressor arrangement of claim 1 further including means for heating oil in said sump means.

4. A duplex compressor arrangement in which a pair of compressors are axially aligned with and driven by a motor with the axial alignment having a variable steady state orientation of ±5° from horizontal comprising:

oil sump means at a lower elevation than said compressors and including a tube assembly extending into said sump means and having at least one inlet opening therein;

a pair of oil pump means for feeding oil to each of said compressors and having suction lines fluidly connected to said tube assembly and fluidly communicating with the oil in said oil sump means via said at least one inlet opening;

a pair of bypass means for bypassing oil from each of said oil pump means to the corresponding suction line connected thereto;

filter means in each of said bypass means whereby filtered bypass oil is introduced directly back to said suction lines;

a pair of return lines connected to each of said compressors and said oil sump means for draining excess oil from said compressors; and a pair of equalizing lines connected to each of said compressors and said oil sump means for equalizing pressure in each of said compressors and said oil sump means and for serving as a secondary drain for draining excess oil which tends to accumulate in said compressors when oriented in an other than horizontal position.

* * * * *